US005360083A

United States Patent [19]

Hede

[11] Patent Number: 5,360,083

[45] Date of Patent: Nov. 1, 1994

[54] SAFETY DESCENDER FOR A ROPE

[75] Inventor: Jean-Marc Hede, La Tronche, France

[73] Assignee: Zedel, Crolles, France

[21] Appl. No.: 130,435

[22] Filed: Oct. 1, 1993

[30] Foreign Application Priority Data

Oct. 12, 1992 [FR] France ..... 92 12325

[51] Int. Cl.[5] ..... A63B 29/00

[52] U.S. Cl. ..... 182/5; 182/192; 188/65.4

[58] Field of Search ..... 182/5–7, 182/191–193; 188/65.1–65.5

[56] References Cited

FOREIGN PATENT DOCUMENTS 303388 2/1989 European Pat. Off. ..... 182/5
0398819 11/1990 European Pat. Off. .
2422587 11/1979 France .
2554102 5/1985 France .
2044414 10/1980 United Kingdom ..... 182/5

*Primary Examiner*—Alvin C. Chin-Shue
*Attorney, Agent, or Firm*—Stevens, Davis, Miller & Mosher

[57] ABSTRACT

The descender comprises a first flange for support of a pulley and a pad, and an auxiliary braking lever mounted with limited pivoting near the pulley between an inactive unlocking position for a first winding direction of the rope in the passage space, and an active locking position in which a jamming surface of the lever presses the rope against the pulley. Pivoting of the lever to the active position takes place automatically in case of incorrect winding of the rope according to a second direction opposite to the first direction, and in the presence of a tension on the rope when the descender is on load.

6 Claims, 4 Drawing Sheets

SAFETY DESCENDER FOR A ROPE

BACKGROUND OF THE INVENTION

The invention relates to a descender used for descending a person along a rope, comprising a first fixed flange for support of a pulley and of a stud or pad separated from one another by an internal space for passage of the rope, and a second mobile flange able to occupy a separated position enabling the rope to be wound according to a first predetermined direction onto the pulley and stud in the passage space, and a closed position in which the rope is held captive in the space, movement of the second flange from the separated position to the closed position, and vice-versa, being achieved in a plane appreciably parallel to the first flange by manual action of the user.

The function of a descender must enable a user to descend along a rope of great length in complete safety. In the case of a self-jamming descender, the pulley is shaped as a mobile cam associated with an unlocking handle. If the handle is released during a descending movement, the tension on the rope urges the cam to a locking position, in which the rope is pressed by the cam against a fixed stud or stop. This results in automatic stopping of the descending movement, and the person remains attached to the rope in complete safety. Correct operation of the descender nevertheless remains dependent on a certain direction of winding of the rope on the pulley, said direction being known to all specialists and indicated on the apparatus. The risk of an incorrect direction of passage of the rope is not to be excluded when the descender is handled by novices or inexperienced users. The self-jamming effect of the rope does not occur in case of an assembly error, and this results in incorrect operation of the descender, which may have unfortunate consequences for safety.

The object of the invention consists in achieving a safety descender for a rope which does not jeopardize the life of a person when the direction of passage of the rope in the descender is incorrect.

SUMMARY OF THE INVENTION

The descender according to the invention is characterized in that in the internal space for passage of the rope there is arranged an auxiliary braking lever mounted with limited pivoting close to the pulley between an inactive unlocking position of the rope for said first winding direction and an active locking position in which a jamming surface of the lever presses the rope against the pulley, pivoting of the lever from the inactive position to the active position taking place automatically in the presence of a tension force on the rope, and following incorrect winding according to a second direction opposite from the first direction.

Operation of the auxiliary braking lever takes place only if the direction of passage of the rope in the descender is incorrect, when the user attempts to start the descending movement. The auxiliary lever moving to the position locking the rope prevents any downward movement and blocks the user in the presence of a tension on the rope. Blocking persists so long as the descender remains under load by the tension of the rope. The user's safety is total, even if the rope is handled incorrectly when it is wound on the pulley.

To refit the rope in the correct way, the tension on the rope must first be released and the second flange be swivelled to the separated position. The auxiliary braking lever then returns automatically to the inactive position, clearing the blocking effect.

According to one feature of the invention, the stud is associated with a fixed spacer for positioning of the rope, said spacer being inserted between the two flanges and shaped to confine the two opposite ends for accessing the space for passage of the rope in the descender.

According to a first embodiment of the invention relating to a self-jamming descender, the pulley is shaped as a cam articulated on a first spindle of the first flange and associated with an actuating handle. The pad comprises a braking surface against which the rope is pressed by the cam if the handle is released for the first winding direction of the rope, the locking action by the cam being exerted near the top orifice. The auxiliary braking lever is articulated on a second spindle of the first flange at an intermediate point located between the spacer and pulley, the second spindle being appreciably parallel to the first spindle, so that the angular movement between the active and inactive positions of the jamming surface of the lever takes place near the bottom orifice of the space.

When a descender is in an on-load state, it can be subjected to two types of blocking depending on the direction of winding of the rope:

- a first blocking by the cam, if the handle is released, and for the correct direction of passage of the rope;
- a second blocking by the auxiliary braking lever for the incorrect direction of passage of the rope.

According to a second embodiment of a simple descender, the pulley is mounted fixed on the first flange. The first blocking does not exist, but the second blocking takes place normally in the event of a rope handling error.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
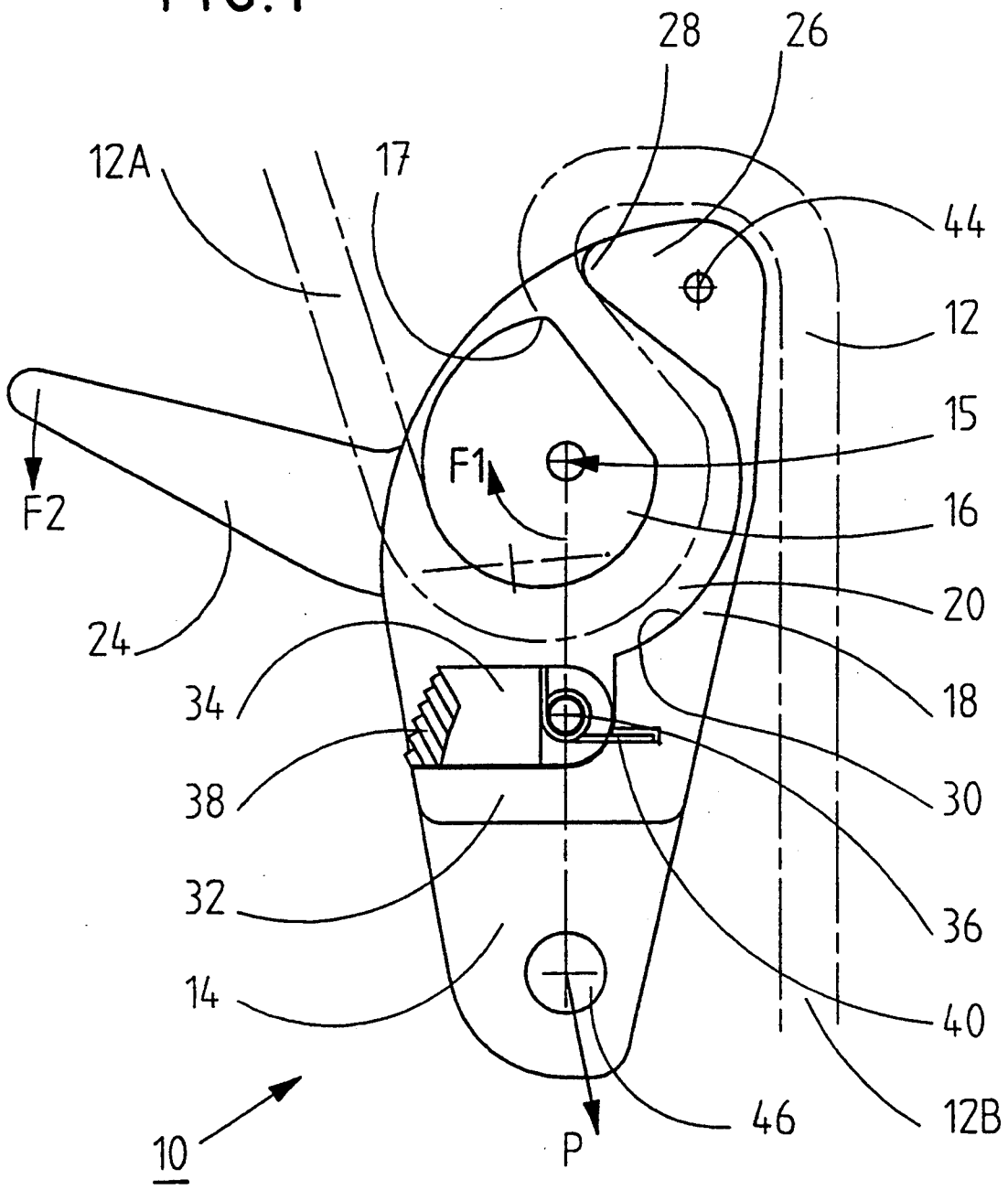
FIG. 1 is a schematic elevational view of a descender according to the invention, with a correct direction of passage of the rope, the second removable flange not being represented.
Figure 2:
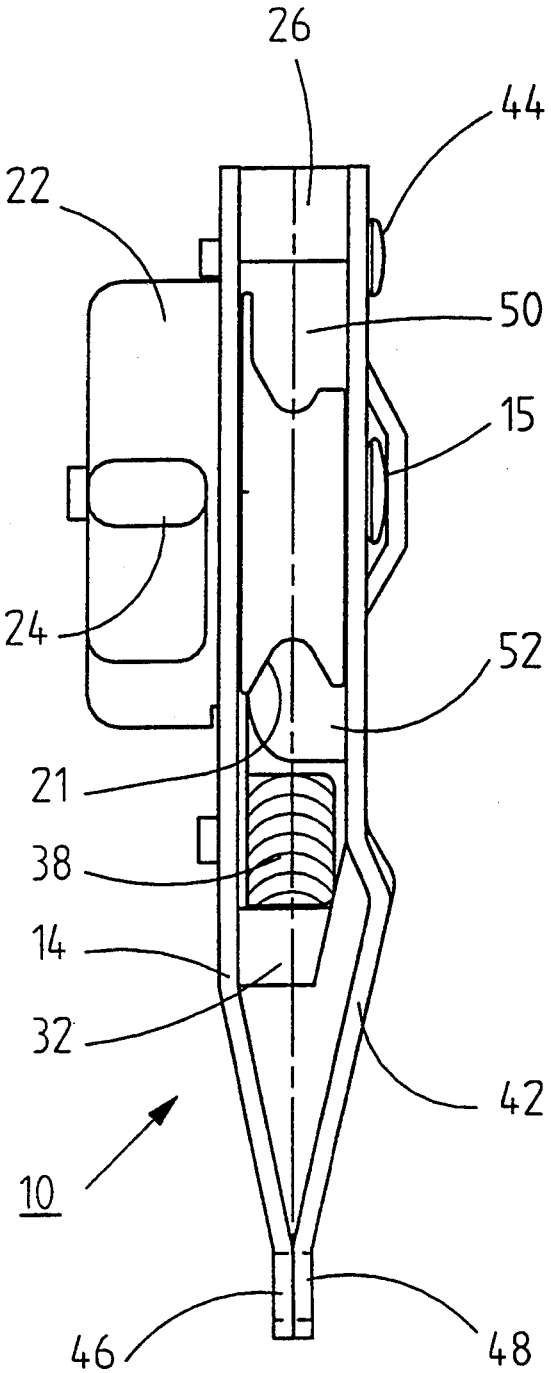
FIG. 2 shows a left-hand side view of the descender of FIG. 1.
Figure 3:
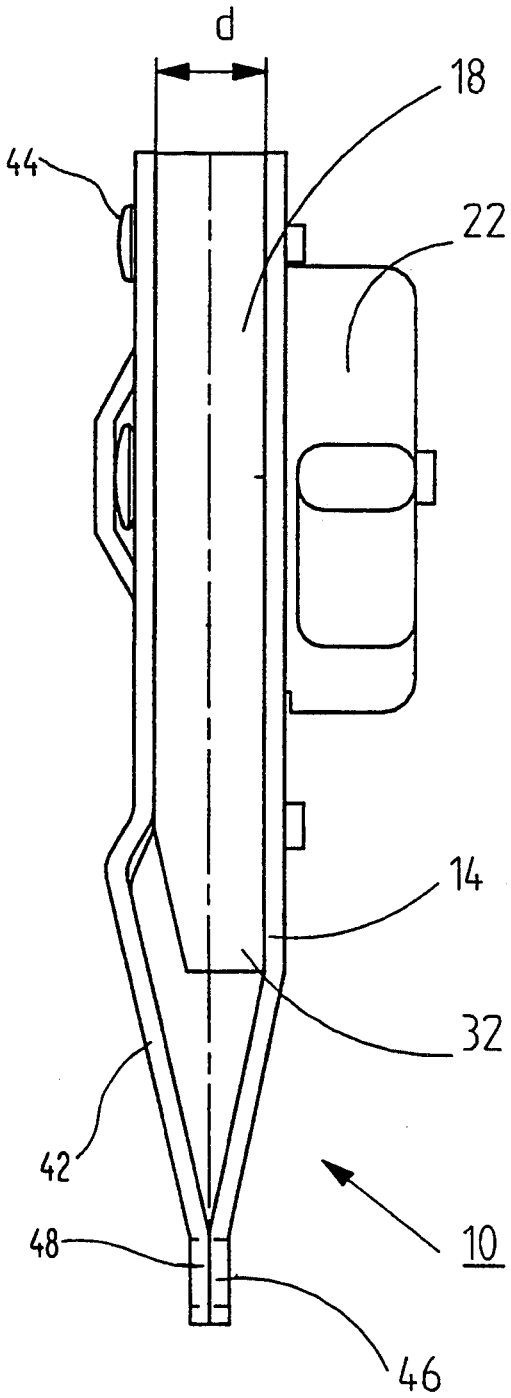
FIG. 3 is a right-hand side view of the descender of FIG. 1.

Referring to FIGS. 1 to 5, a descender designated by the general reference 10, is used for descent of one or more persons along a rope 12. The descender 10 comprises a first fixed flange 14, having a first articulation spindle 15 of a mobile pulley 16 shaped as a cam 17, and a fixed positioning spacer 18, separated from the pulley 16 by a space 20 for passage of the rope 12. The pulley 16 is provided with a guide groove 21 of the rope 12 when the latter is wound in an S in the descender 10.

The pulley 16 is mechanically connected to an operating mechanism equipped with an actuating handle 24, which is mounted with limited pivoting between a raised locking position and a lowered position releasing the rope 12. The upper part of the fixed spacer 18 is arranged as a fixed stud or pad 26 having a braking surface 28 against which the rope 12 is pressed by the locking action of the cam 17 in the raised position of the handle 24.

The intermediate part of the spacer 18 extends externally along the right-hand side of the first flange 14 and presents a curved internal sector 30 appreciably centered on the spindle 15. The combined presence of the groove 21 of the pulley 16 and of the concave curved sector 30 of the spacer 18 enables optimum positioning and guiding of the rope 12 in the space 20 to be obtained.

The lower part of the positioning spacer 18 comprises a cross-member 32 extending horizontally between the two opposing lateral sides of the flange 14. An auxiliary braking lever 34 is pivotally mounted on a second spindle 36 fixedly secured to the flange 14 at an intermediate point situated between the cross-member 32 and pulley 16. The second spindle 36 of the lever 34 extends parallel to the first spindle 15 of the pulley 16 in a direction perpendicular to the first fixed flange 14. The angular movement of the auxiliary lever 34 takes place in the space 20 between an active position (FIGS. 1 and 4) in which the lever 34 bears on the cross-member 32 playing the role of end-of-travel stop, and an active position (FIG. 5) in which a jamming surface 38 of the lever 34 presses the rope 12 against the pulley 16.

A return spring 40, formed for example by a flexion or torsion spring, is wound around the spindle 36 and urges the lever 34 to the inactive position. If the rope 12 is correctly wound, the auxiliary lever 34 remains held continuously in the inactive position and the rope 12 can slide freely on the pulley 16 when the descent is performed. Movement by pivoting of the lever 34 to the active position takes place during the descending movement only when the direction of passage of the rope 12 in the space 20 is incorrect.

A second mobile flange 42 having a similar shape to that of the first flange 14 is mounted with swivelling on a third spindle 44 passing through the spacer 18 near the pad 26. Movement of the second flange 42 takes place in a plane parallel to the first flange 14 by manual action of the user between a closed position (FIGS. 2 and 3) in which the rope 12 is held securely in the space 20 and a separated position (not represented) enabling the rope 12 to be fitted or removed. Movement of the second flange 42 to the separated position requires a pivoting movement of an amplitude greater than a quarter-turn, exerted clockwise. The two parallel flanges 14, 42 are separated from one another by a transverse gap, having a thickness which corresponds to that of the spacer 18.

Each flange 14, 42 comprises at its base a circular or oblong orifice 46, 48 designed for passage of a karabiner (not represented) for attaching the descender 10 to the user's harness. In the closed position of the second flange 42, the two orifices 46, 48 are aligned (FIG. 2) and fitting of the karabiner keeps the descender 10 closed preventing any untimely opening of the second flange 42.

The first locking action of the rope 12 exerted by the cam 17 on the braking surface 28 of the pad 26, and the second locking action of the rope 12 by the jamming surface 38 of the auxiliary lever 34 on the pulley 16, take place near the two opposite ends 50, 52 for accessing the space 20 (FIG. 2) for passage of the rope 12.

The first spindle 15 of the pulley 16, the second spindle 36 of the auxiliary lever 34 and the orifice 46 of the flange 14 are appreciably aligned in a vertical direction perpendicular to the cross-member 32 of the spacer 18 and to the lever 34 in the inactive position.

Operation of the safety descender 10 according to the invention is as follows:

When the direction of passage of the rope 12 in the space 20 of the descender 10 is correct (FIG. 1), the top strand 12A of the rope 12, attached to a securing component (not represented) located above the descender 10, enters the space 20 via the bottom end 52 forming an S-shaped meander which exits via the other top end 50 to form the bottom strand 12B directed downwards. Inside the space 20, the rope 12 never comes into contact with the jamming surface 38 of the auxiliary lever 34, which remains in the inactive position up against the cross-member 32 due to the flexible action of the return spring 40. In the course of the descending movement, the action of the weight P applied to the base of the flanges 14, 42 and that of the tension force F exerted on the top strand 12A of the rope 12, bring about driving of the pulley 16 in clockwise rotation (see arrow F1), in the event of releasing of the handle 24, which is urged to the raised position. The cam 17 of the pulley 16 presses the rope 12 against the braking surface 28 of the pad 26 at the level of the top end 50 of the space 20, which results in immediate stopping of the descending movement. Counterclockwise pivoting of the handle 24 (see arrow F2) to the lowered position results in a progressive separation of the cam 17, and unlocking of the rope 12 enabling the descending movement to be continued.

If the rope 12 is incorrectly wound around the pulley 16 of the descender 10 (see FIG. 4), the top strand 12A enters the space 20 via the top orifice 50, and exits via the bottom orifice 52 forming a half-loop. The weight of the bottom strand 12B itself applies the rope 12 with no load against the jamming surface 38 of the auxiliary lever 34 and keeps this lever in the inactive position in the absence of tension force on the rope.

Figure 4:
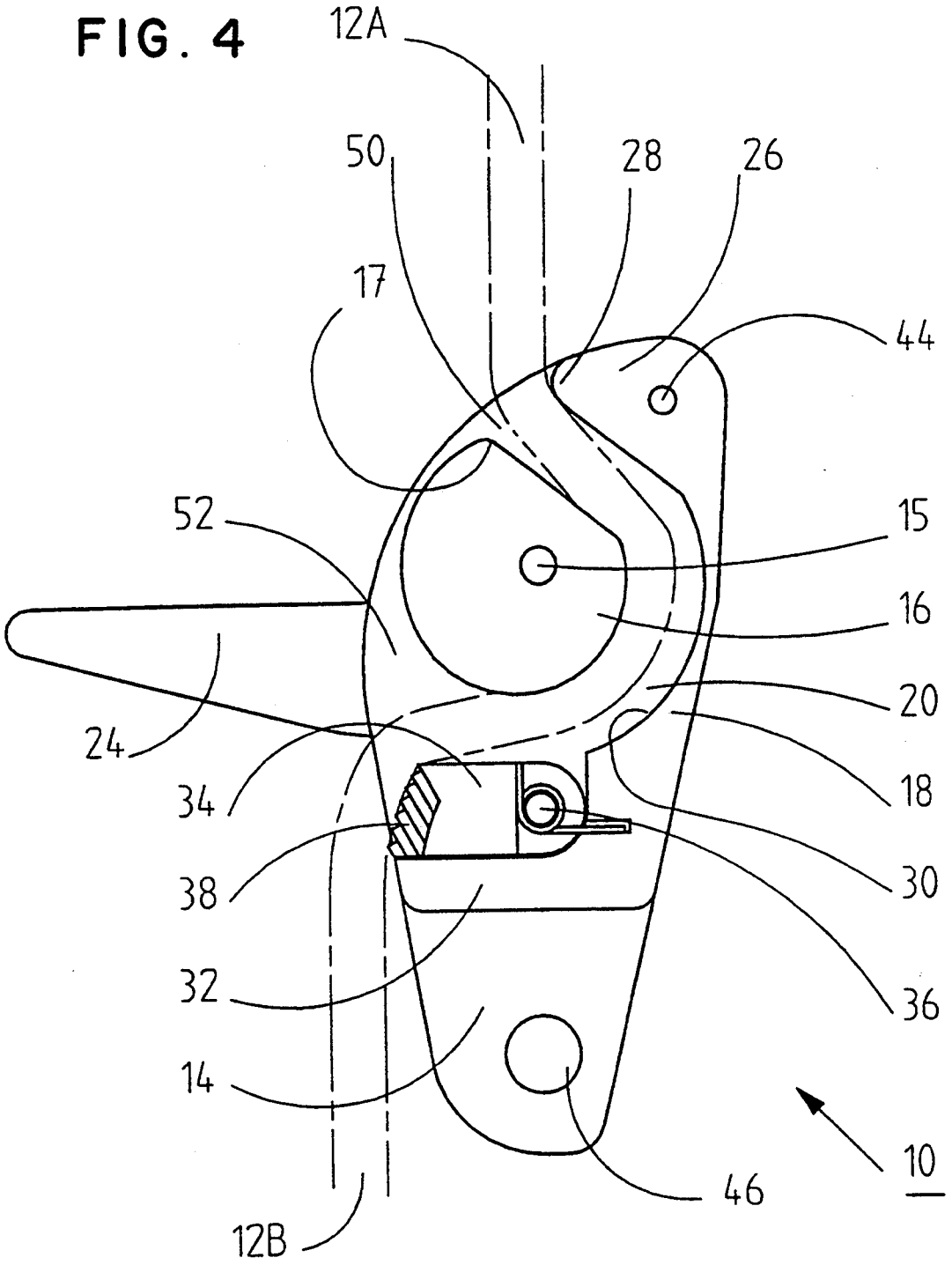
FIGS. 4 and 5 are identical views to FIG. 1, with an incorrect direction of passage of the rope.
Figure 5:
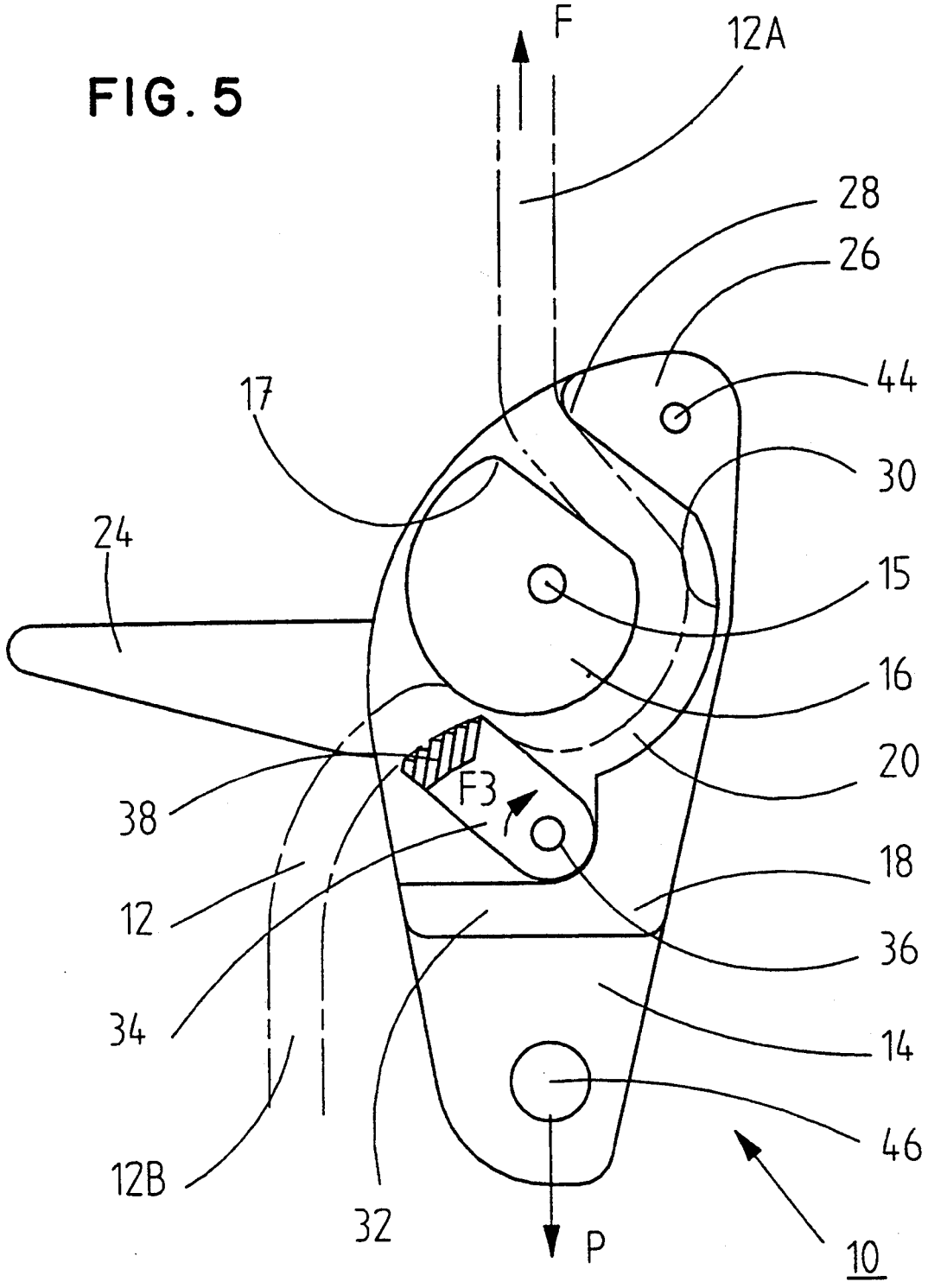

If, starting from the position in FIG. 4, the descending movement is started with an incorrect direction of passage of the rope 12, the rope running in the space 20 of the descender 10 drives the auxiliary braking lever 34 in rotation to the active position (see arrow F3) in which the jamming surface 38 presses the rope against the pulley 16 at the level of the bottom end 52. The tension force F of the rope 12 is unable to drive the pulley 16 in rotation and the latter remains immobile in the separated unlocking position at the level of the top end 50, if the handle 24 is released. Locking of the rope 12 is performed in the bottom end 52 only by the presence of the auxiliary braking lever 34, resulting in automatic stopping of the descending movement. Locking continues so long as the descender 10 remains under load by the tension force F of the rope 12, regardless of the angular position of the actuating handle 24.

If locking occurs, the user realizes that the direction of passage of the rope 12 is incorrect as soon as actuating the handle 24 in the unlocking direction has no effect. He then merely has to take his weight on his feet on a flat surface to release the tension F exerted on the rope. The auxiliary lever 34 returns automatically to the inactive position in FIG. 4, clearing the locking action on the rope 12. It is then easy to refit the rope 12 in the correct direction of passage in FIG. 1.

According to an alternative embodiment, the pulley 16 could be fixed. In this case, the mechanism 22 and its handle 24 are removed.

The descender 10 is made of aluminium-based metallic material. It is however possible to manufacture the spacer 18 by moulding of a plastic material. In this case, the pad 26 is formed by a distinct metallic part adjoined to the spacer 18.

I claim:

1. A descender used for abseiling a person along a rope comprising:

a first flange having lateral edges;

a second flange pivotally mounted parallel to said first flange, and being movable between a closed position and an opened position;

a pulley mounted on said first flange;

stationary spacer means positioned together with said pulley transversely between said first and second flanges;

said flanges, pulley and spacer means defining:

an internal space arranged between the pulley and the spacer means having a bottom orifice and a top orifice for the entry of the rope via said bottom orifice and the exit of said rope from said top orifice;

an auxiliary braking lever pivotally mounted on said first flange to enable said rope to pass between said lever and said pulley for locking automatically the rope when a tension force is applied to the rope following incorrect winding of the rope from the top orifice to the bottom orifice;

and a return spring urging said auxiliary braking lever out of contact with said rope.

2. The descender according to claim 1 including a first spindle and wherein said pulley defines a movable cam, said pulley being mounted on said first flange about said first spindle which extends perpendicularly to said first flange, said pulley having a handle operatively attached thereto and said spacer defines a braking surface against which the rope is pressed by the cam when the handle is released and the rope has been passed from the bottom orifice to the top orifice.

3. The descender according to claim 2 including a second spindle and wherein said auxiliary braking lever, defining a jamming surface, pivots on said second spindle mounted on said first flange, said second spindle extending parallel to said first spindle, and being located between said spacer and said rope, so that angular movement of said jamming surface of said lever takes place near the bottom orifice of the space.

4. The descender according to claim 2, wherein said spacer defines an intermediate part in the form of a concave sector and a cross-member, said intermediate part facing said pulley between said braking surface, and said cross-member which extends horizontally between said opposite lateral edges of said first flange.

5. The descender according to claim 4, wherein said lever is biased against said cross-member of said spacer when said rope has been passed from said bottom orifice to said top orifice.

6. The descender according to claim 3, wherein each flange comprises a base with an orifice for passage of an attachment karabiner, the orifice of said first flange being in alignment with the first spindle of the pulley and the second spindle of the auxiliary braking lever.

* * * * *